US011021829B2

(12) United States Patent
Suh et al.

(10) Patent No.: US 11,021,829 B2
(45) Date of Patent: Jun. 1, 2021

(54) WASHING MACHINE

(71) Applicant: SAMSUNG ELECTRONICS CO., LTD., Suwon-si (KR)

(72) Inventors: Seung Wook Suh, Yongin-si (KR); Jung Hoon Hwang, Yongin-si (KR); Cheol Yeon Jo, Seoul (KR); Jae Won Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 99 days.

(21) Appl. No.: 16/324,425

(22) PCT Filed: Jul. 3, 2017

(86) PCT No.: PCT/KR2017/007015
§ 371 (c)(1),
(2) Date: Feb. 8, 2019

(87) PCT Pub. No.: WO2018/030637
PCT Pub. Date: Feb. 15, 2018

(65) Prior Publication Data

US 2019/0177899 A1 Jun. 13, 2019

(30) Foreign Application Priority Data

Aug. 8, 2016 (KR) ..... 10-2016-0100823

(51) Int. Cl.
*D06F 37/16* (2006.01)
*D06F 37/24* (2006.01)
(Continued)

(52) U.S. Cl.
CPC ..... *D06F 37/16* (2013.01); *D06F 37/24* (2013.01); *D06F 37/26* (2013.01); *D06F 37/245* (2013.01); *D06F 37/40* (2013.01)

(58) Field of Classification Search
CPC ..... D06F 37/16; D06F 37/24; D06F 37/26; D06F 37/245; D06F 37/40
(Continued)

(56) References Cited

U.S. PATENT DOCUMENTS

2012/0291497 A1* 11/2012 Scarafiotti ..... D06F 37/08 68/139
2013/0036776 A1* 2/2013 Seo ..... D06F 37/206 68/18 F
2015/0211163 A1* 7/2015 Kim ..... D06F 17/10 68/133

FOREIGN PATENT DOCUMENTS

JP 9-239191 9/1997
KR 2000-0018236 10/2000
(Continued)

OTHER PUBLICATIONS

KR20000018236U—Machine translation (Year: 2000).*
(Continued)

*Primary Examiner* — Tinsae B Ayalew
(74) *Attorney, Agent, or Firm* — Staas & Halsey LLP

(57) ABSTRACT

Disclosed is a washing machine. The disclosed washing machine comprises: a cabinet having an opening; a water tank provided inside the cabinet and storing washing water; a washing tub provided inside the water tank in a rotatable manner and defining a washing space, the washing tub including a balancer that is provided at one side of the washing tub and includes a drain formed on at least a portion of the periphery thereof; and a separating plate mounted to the washing tub in a separable manner so as to selectively divide the washing space of the washing tub into a first washing space and a second washing space.

14 Claims, 14 Drawing Sheets

(51) Int. Cl.
*D06F 37/26* (2006.01)
*D06F 37/40* (2006.01)

(58) Field of Classification Search
USPC ..... 68/212
See application file for complete search history.

(56) References Cited

FOREIGN PATENT DOCUMENTS

| | | |
|---|---|---|
| KR | 10-0776601 | 11/2007 |
| KR | 10-2015-0089344 | 8/2015 |
| KR | 10-2015-0125547 | 11/2015 |

OTHER PUBLICATIONS

KR20150125547A—Machine translation (Year: 2015).*
KR100776601B1—Machine translation (Year: 2002).*
International Search Report dated Sep. 20, 2017 in corresponding International Application No. PCT/KR2017/007015.
Written Opinion of the International Searching Authority dated Sep. 20, 2017 in corresponding International Application No. PCT/KR2017/007015.
Korean Office Action dated Aug. 24, 2020 in Korean Patent Application No. 10-2016-0100823.
Korean Office Action dated Feb. 19, 2021 in Korean Patent Application No. 10-2016-0100823.
Korean Notice of Allowance dated Apr. 8, 2021 in Korean Patent Application No. 10-2016-0100823.

* cited by examiner

WASHING MACHINE

CROSS-REFERENCE TO RELATED APPLICATIONS

This application is a National Phase application, under 35 U.S.C. § 371, of international application No. PCT/KR2017/007015 filed Jul. 3, 2017, which claims Convention Priority to Korean patent application No. 10-2016-0100823 filed Aug. 8, 2016, the entire disclosures of which are herein incorporated by reference as a part of this application.

TECHNICAL FIELD

The present disclosure relates to a washing machine, and more particularly, to a washing machine capable of performing separate washing.

BACKGROUND ART

A washing machine is a machine which washes clothes using power and generally includes a water tank storing washing water, a washing tub rotatably installed inside the water tank, and a pulsator rotatably provided at a bottom of the washing tub.

Generally, a washing machine includes one washing tub. Accordingly, in order to prevent pieces of laundry from color-bleeding due to other pieces of laundry or to wash relatively clean clothes such as underwear separately from relatively less clean clothes such as socks, a user should run the washing machine two times or more.

Accordingly, although an amount of laundry is not much, a user should run the washing machine for a long time and thus power consumption increases.

Also, recently, washing machines capable of performing separate washing by separately rotating each of two washing tubs provided therein have been provided. However, since it is necessary to include driving sources for separately rotating the washing tubs, separate washing may be performed but power consumption may not be reduced.

DISCLOSURE

Technical Problem

The present disclosure is directed to providing a washing machine capable of performing separate washing at the same time using a simple single configuration.

The present disclosure is also directed to providing a washing machine capable of performing separate washing at the same time using a single driving source.

The present disclosure is also directed to providing a washing machine capable of performing separate washing at the same time using a single washing tub.

The present disclosure is also directed to providing a washing machine capable of preventing washing water in separated washing spaces from being mixed with each other.

The present disclosure is also directed to providing a washing machine capable of draining washing water from separated washing spaces using a simple configuration.

The present disclosure is also directed to providing a washing machine capable of preventing pieces of laundry in separated washing spaces from deviating therefrom.

The present disclosure is also directed to providing a washing machine capable of storing a separating plate, which separates a washing space, when not in use.

Technical Solution

One aspect of the present disclosure provides a washing machine including a cabinet including an opening, a water tank provided inside the cabinet and storing washing water, a washing tub rotatably provided inside the water tank, forming a washing space, and including a rotating tub and a balancer provided on one side of the rotating tub and including drainage holes formed in at least one part of a perimeter thereof, and a separating plate separably mounted in the washing tub to optionally separate the washing space of the washing tub into a first washing space and a second washing space.

The separating plate may include a sealing member provided on at least one part of a perimeter thereof.

The drainage holes may be configured to drain washing water of the second washing space to the outside of the washing tub using a centrifugal force when the balancer rotates at a predetermined speed.

The drainage holes may be configured to guide washing water of the second washing space to the outside of the washing tub but still inside the water tank.

The balancer may include a hinge fixing portion provided at one part of an inner circumferential surface of the balancer, and the separating plate may include a hinge connection portion provided on one part of an outer circumferential surface of the separating plate and configured to be separably hinge-connected to the hinge fixing portion.

The balancer may include an insertion fixing portion provided at another part of the inner circumferential surface of the balancer, and the separating plate may include an insertion connection portion provided on another part of the outer circumferential surface of the separating plate and configured to be separably inserted into the insertion fixing portion.

The balancer may include a balancer fixing portion provided on one part of an inner circumferential surface of the balancer and protruding toward an inside of the balancer to fix the separating plate when the separating plate is mounted in the washing tub and a rotation preventer provided on another part of the inner circumferential surface of the balancer and protruding toward the inside of the balancer to restrict the separating plate from rotation in one direction with respect to the washing tub.

The separating plate may include a separating plate fixing portion provided on at least one part of an outer circumferential surface of the separating plate to be fixed by the balancer fixing portion of the balancer and the rotation preventer, and the separating plate fixing portion may be configured to move to a position of being fixed by the balancer fixing portion as the separating plate rotates in the one direction with respect to the washing tub.

The cabinet may include a separating plate storage device provided to store the separating plate when the separating plate is separated from the balancer.

The separating plate storage device may include a separating plate drawer which accommodates the separating plate and is slidably drawn into or withdrawn from the cabinet.

The balancer may include a separation preventer provided on at least one part along a perimeter of the balancer and extending toward a rotational axis of the balancer.

The separating plate may include a handle protruding from one surface facing the opening of the cabinet when the separating plate is mounted on the balancer.

The balancer may include a drainage guide surface formed to be inclined in a direction of receding from a rotational axis of the balancer as it goes from one part of an inner circumferential surface of the balancer, on which the separating plate is mounted, toward another part of the inner circumferential surface of the balancer, in which the drainage holes are formed.

The balancer may include a balancer blade protruding from an inner circumferential surface of the balancer.

The separating plate may include a transparent portion having transparency to see an inside of the first washing space when the separating plate is mounted in the washing tub.

Another aspect of the present disclosure provides a washing machine including a cabinet including an opening, a water tank provided inside the cabinet and storing washing water, a washing tub rotatably provided inside the water tank and including a balancer provided at a top thereof, and a separating plate separably mounted in the washing tub to optionally separate the washing space of the washing tub into a first washing space and a second washing space and including a sealing member provided on at least one part of a perimeter thereof. Here, the balancer includes drainage holes in at least one part of a perimeter thereof, and the drainage holes are configured to drain washing water of the second washing space to a space between the water tank and the washing tub.

The balancer may include a drainage guide surface formed to be inclined in a direction of receding from a rotational axis of the balancer as it goes from a bottom end of an inner circumferential surface of the balancer, toward a top end thereof.

Still another aspect of the present disclosure provides a washing machine including a cabinet and a washing tub rotatably provided in the cabinet, forming a first washing space and a second washing space, and including a fixing portion on at least one part of an inner circumferential surface thereof, and including a rotating tub and a balancer provided on one side of the rotating tub. Here, the washing tub is configured such that washing water of the second washing space crosses the balancer and is drained to the outside of the second washing space due to a centrifugal force when the washing tub rotates.

The fixing portion may have a groove shape by recessing the inner circumferential surface of the washing tub.

The fixing portion may include a balancer fixing portion protruding from the inner circumferential surface of the washing tub.

Advantageous Effects

According to the concept of the present disclosure, since it is possible to install a separating plate in a washing tub using a simple method in a washing machine, a washing space of the washing tub can be simply separated according to a user's need.

According to the concept of the present disclosure, since it is possible to separate one washing tub into two washing spaces using a separating plate in a washing machine, separate washing can be performed at the same time using one washing tub.

According to the concept of the present disclosure, since two washing spaces are rotated together by rotating one washing tub in a washing machine, separate washing can be performed at the same time using one driving source.

According to the concept of the present disclosure, since a washing machine is provided such that a space between a separating plate and a washing tub is sealed while the separating plate separates a washing space, it is possible to prevent pieces of laundry from color-bleeding by preventing washing water in separated washing spaces from being mixed with each other.

According to the concept of the present disclosure, since a washing machine is configured such that washing water of one of separated washing spaces formed by a balancer crosses the balancer due to a centrifugal force caused by rotation of a washing tub and is drained, an additional drainage device is unnecessary and a product unit cost can be reduced.

According to the concept of the present disclosure, since a washing machine includes a separation preventer at one end of a washing tub, it is possible to prevent laundry from deviating from a separated washing space.

According to the concept of the present disclosure, since a washing machine includes a separating plate storage device, a separating plate can be easily stored when not in use.

MODES OF THE INVENTION

Figure 1:
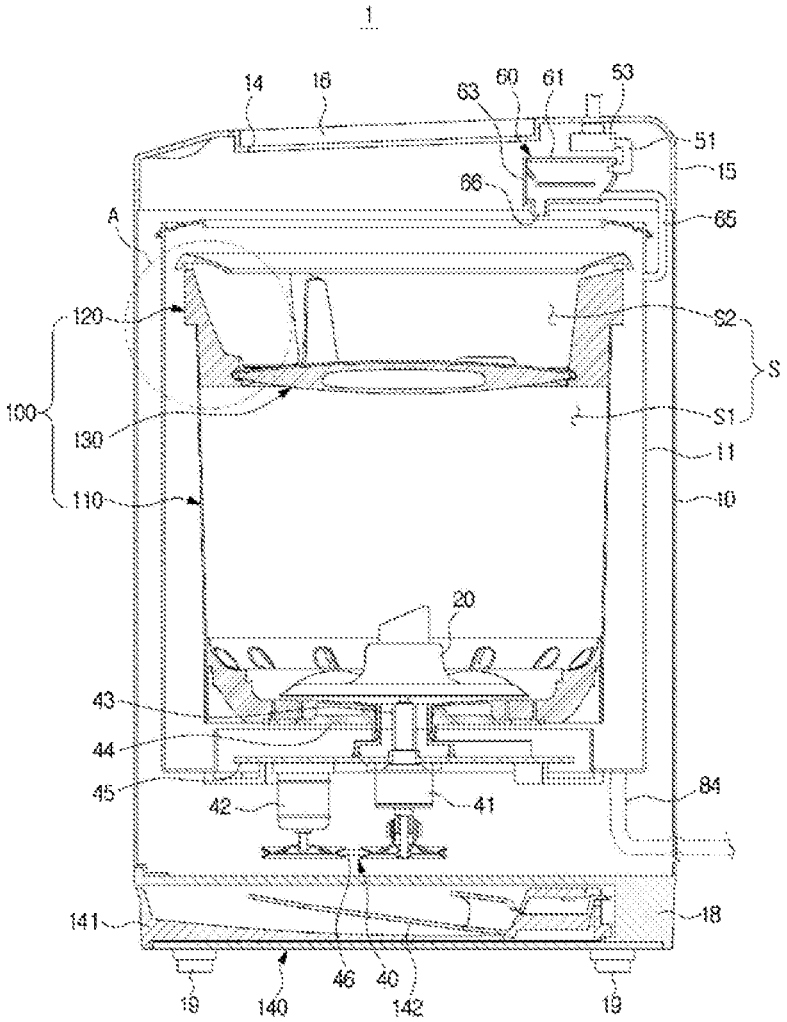
FIG. 1 is a cross-sectional view illustrating a washing machine according to one embodiment of the present disclosure.

Embodiments described herein and components shown in the drawings are merely exemplary examples. Also, a variety of modified examples with which these embodiments and the drawings are replaceable may be present at the time of filing of the present application.

Also, the same reference numerals or symbols shown in the drawings refer to components or elements configured to perform substantially the same function.

Also, the terms used herein explain the embodiments but are not intended to restrict and/or limit the present disclosure. Singular expressions, unless clearly defined otherwise in context, include plural expressions. Throughout the specification, the terms "comprise," "have," and the like are used herein to specify the presence of stated features, numbers, stages, operations, elements, components or combinations thereof but do not preclude the presence or addition of one or more other features, numbers, stages, operations, elements, components, or combinations thereof.

Also, even though the terms including ordinals such as "first", "second", and the like may be used to describe a variety of elements, the elements are not be limited by the terms and the terms are used only for distinguishing one element from another. For example, without departing from the scope of the present disclosure, a first element may be referred to as a second element, and similarly, a second element may be referred to as a first element. The term "and/or" includes any and all combinations of one or a plurality of associated listed items.

Meanwhile, the terms used herein such as "a front end," "a rear end," "a top," "a bottom," "a top end," "a bottom end," and the like are defined on the basis of the drawings, and shapes and positions of elements are not restricted by the terms.

Hereinafter, embodiments of the present disclosure will be described in detail with reference to the attached drawings.

FIG. 1 is a cross-sectional view of a washing machine 1 according to one embodiment of the present disclosure.

As shown in FIG. 1, the washing machine 1 may include a cabinet 10, a water tank 11 disposed inside the cabinet 10 and storing washing water, a washing tub 100 rotatably disposed inside the water tank 11, a pulsator 20 disposed inside the washing tub 100 and generating water currents, and a driving device 30 rotating the washing tub 100.

An upper cover 15, in which an opening 14 for inserting laundry into the washing tub 100 is formed, may be provided above the cabinet 10, and a door 16, which opens or closes the opening 14, may be provided at the upper cover 15.

A lower cover 18, with which a mounting portion 19 is combined, may be provided below the cabinet 10 so as to mount the washing machine 1 on a bottom surface. A separating plate storage device 140 is provided inside the lower cover 18 to accommodate a separating plate 130, which will be described below, and will be described below.

A suspension member (not shown) for supporting the washing tub 100 by suspending the washing tub 100 from the cabinet 10 may be connected to a top of the cabinet 10.

The washing tub 100 may be rotatably disposed inside the cabinet 10 and may include a plurality of through holes (not shown) formed along a perimeter thereof.

The pulsator 20 is rotatably installed on a bottom of the washing tub 100, and the pulsator 20 may agitate the laundry inserted into the washing tub 100 with washing water.

A water supply device 50 for supplying washing water to an inside of the washing tub 100 may be provided above the washing tub 100. The water supply device 50 may include a water supply valve 53 controlling water supply and a water supply tube 51 connecting the water supply valve 53 to a detergent supply device 60.

One side of the water supply tube 51 may be connected to an external water supply source (not shown), and the other side of the water supply tube 51 may be connected to the detergent supply device 60. The detergent supply device 60 may include a case 63 provided inside the upper cover 15 and a detergent container 61 separably mounted in the case 63 and accommodating each detergent. A first outlet 65 and a second outlet 66 for discharging washing water, in which a detergent is dissolved, into a first washing space S1 and a second washing space S2, respectively, may be formed in a bottom surface of the case 63.

In detail, water supplied through the water supply tube 51 may be supplied into the washing tub 100 with the detergent via the detergent supply device 60. Here, when the separating plate 130 is installed in the washing tub to perform separate washing, a part of the washing water may be discharged into a space between the water tank 11 and the washing tub 100 through the first outlet 65 and supplied to the first washing space S1 and the rest of the washing water may be discharged into the washing tub 100 through the second outlet 66 and supplied to the second washing space S2.

However, components of the water supply device 50 are not limited thereto and any components capable of supplying washing water into each of the first washing space S1 and the second washing space S2 may be applied thereto.

A drain hose 84, which guides washing water to the outside of the cabinet 10 after a washing or spin-drying process is completely performed, may be provided below the washing tub 100.

The driving device 40 may include a clutch 41 selectively rotating the washing tub 100 and the pulsator 20, a driving motor 42 driving the clutch 41, a flange member 44 connecting a driving shaft 43 of the clutch 41 to the bottom of the washing tub 100 to transfer the torque of the driving shaft 43 to the washing tub 100, and a base plate 45 which fixes the clutch 41 and the driving motor 42. Also, the driving device 40 may include a pulley 46 which fixes the clutch 41 and the driving motor 42.

Figure 2:
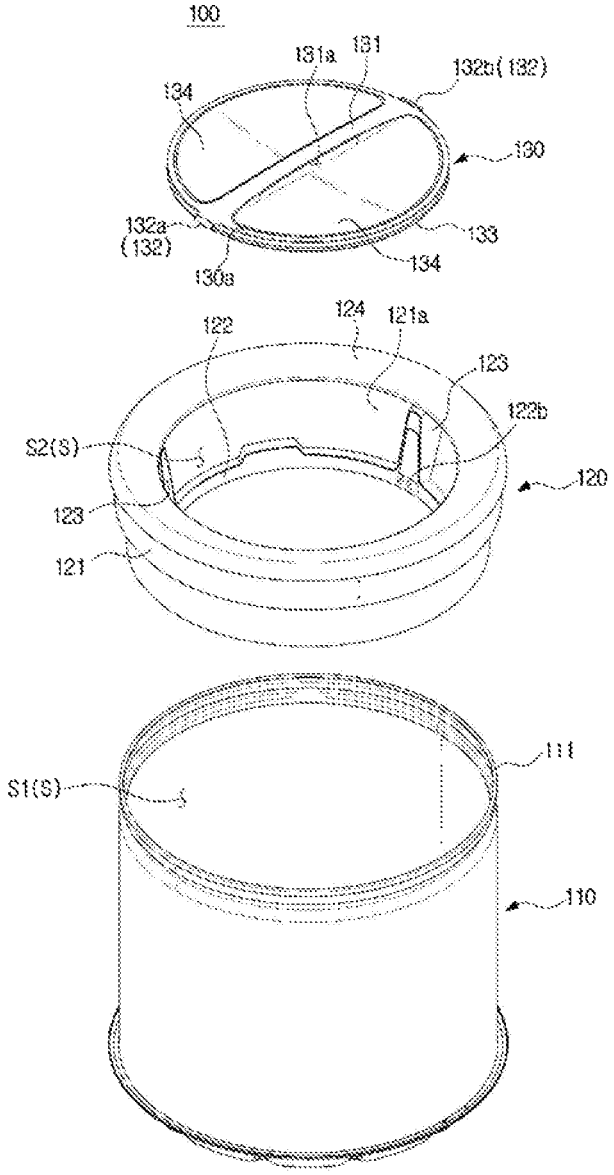
FIG. 2 is an exploded view illustrating a rotating tub, a balancer, and a separating plate of the washing machine according to one embodiment of the present disclosure, which are disassembled.
Figure 3:
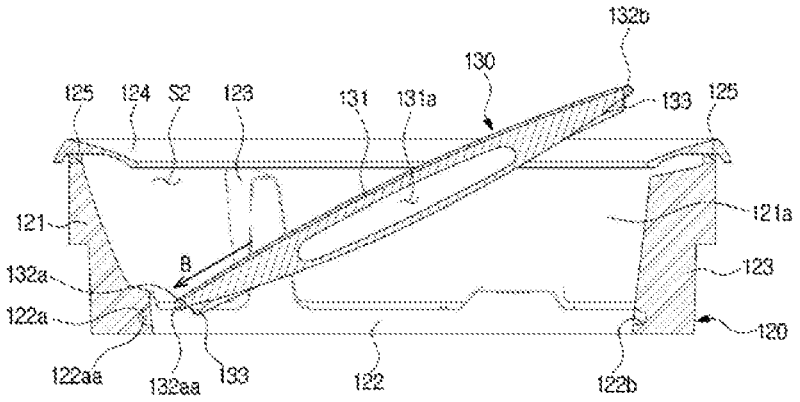
FIGS. 3 to 5 are views illustrating a process of mounting the separating plate of the washing machine according to one embodiment of the present disclosure on the balancer.
Figure 4:
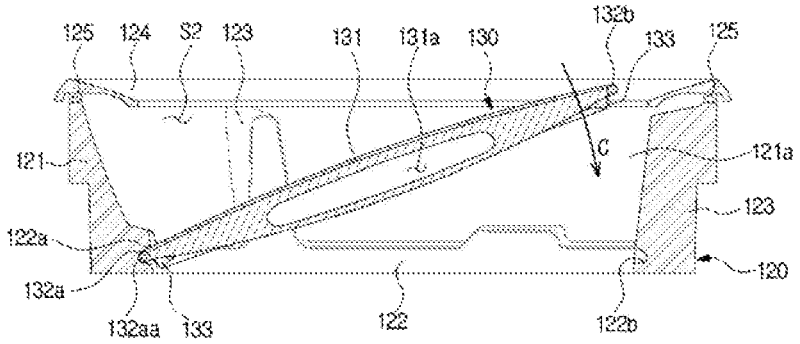
Figure 5:
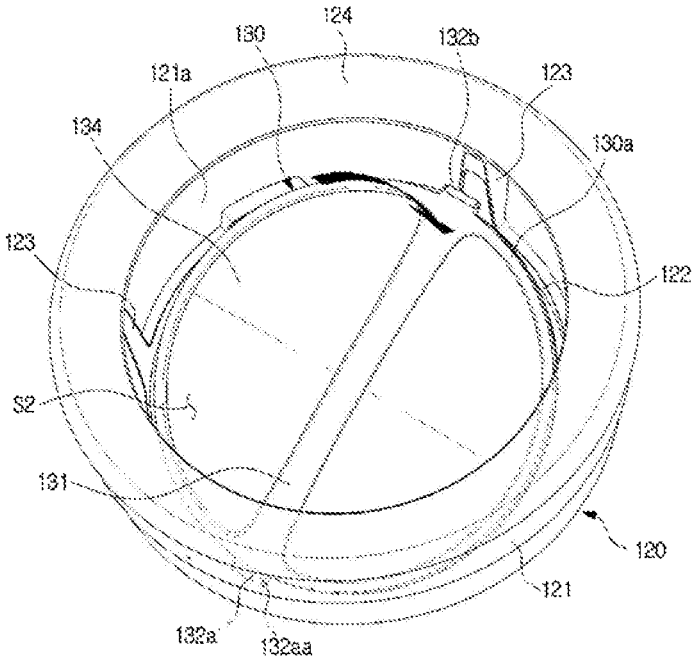
Figure 6:
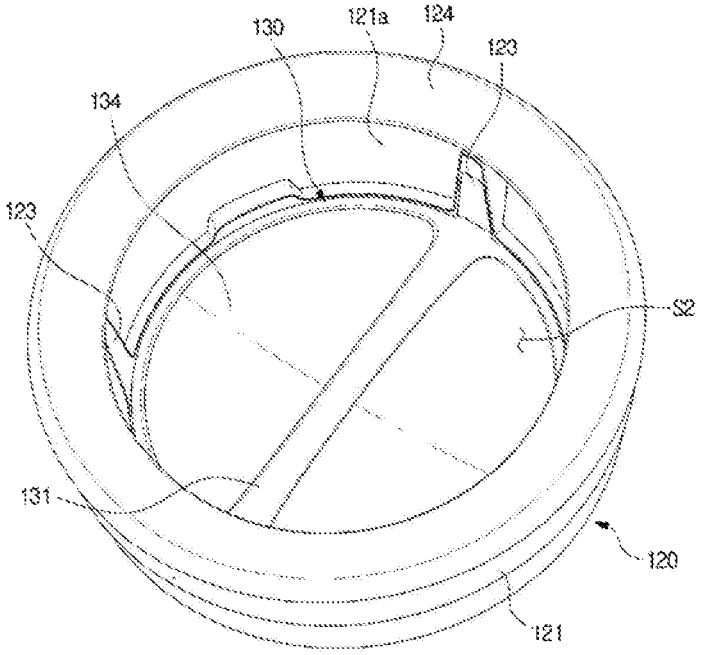
FIG. 6 is a view illustrating a state in which the separating plate of the washing machine is mounted on the balancer according to one embodiment of the present disclosure.
Figure 7:
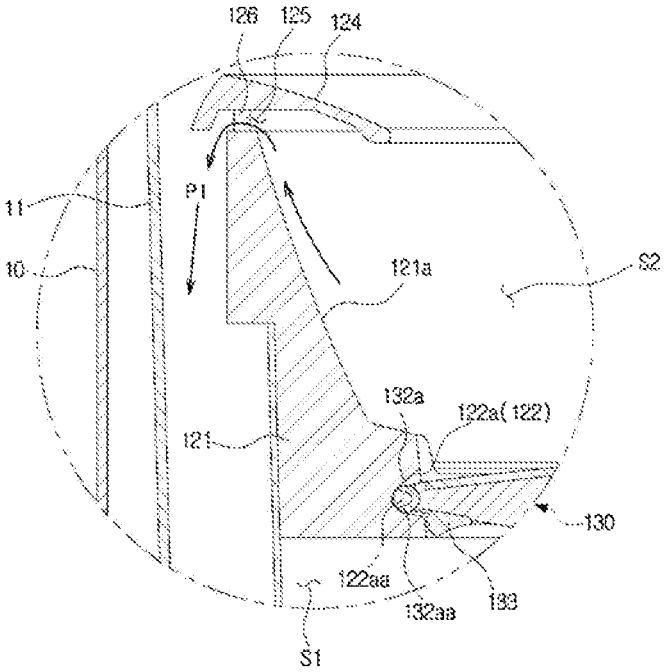
FIG. 7 is an enlarged view illustrating a part A shown in FIG. 1.
Figure 8:
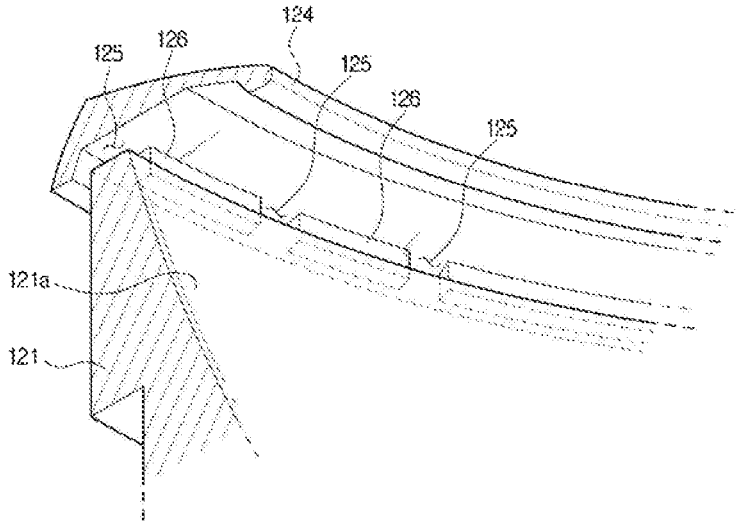
FIG. 8 is a view illustrating a cross section shown in FIG. 7 when viewed obliquely from below.
Figure 9:
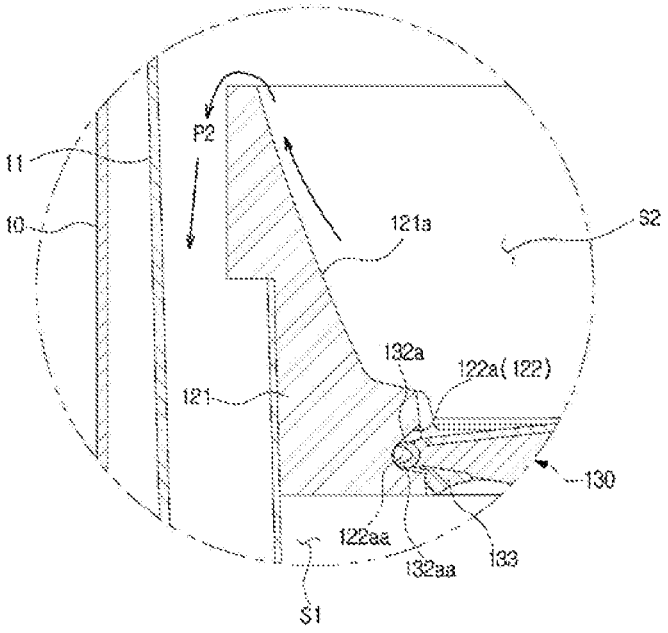
FIG. 9 is a view illustrating a case in which a separation preventer is omitted from the balancer shown in FIG. 7.
Figure 10:
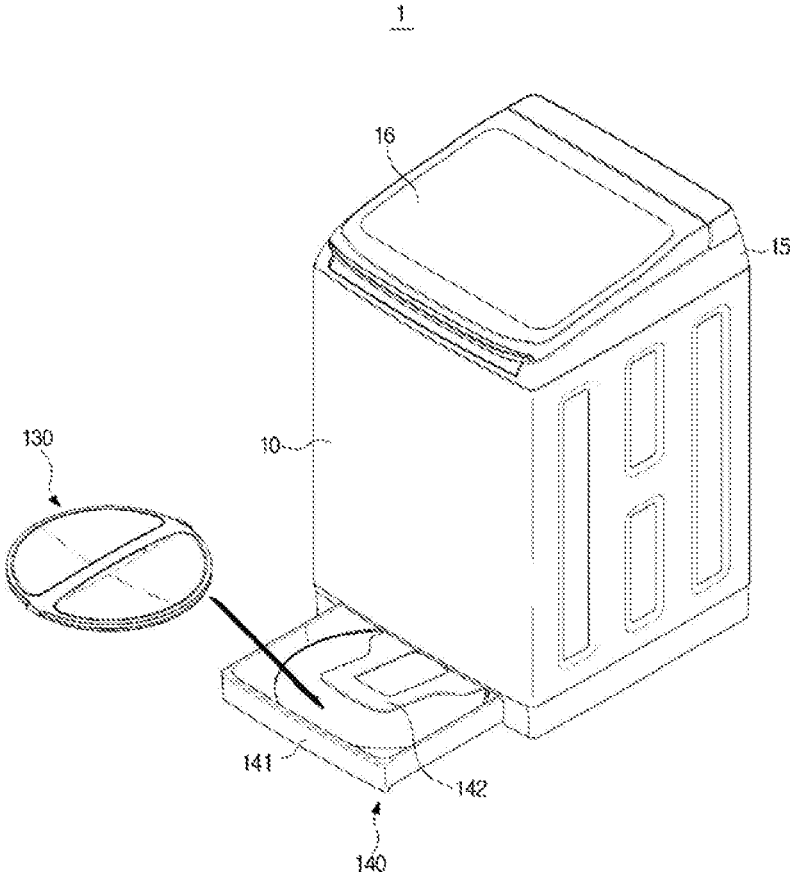
FIG. 10 is a view illustrating a process of storing the separating plate when not in use in the washing machine shown in FIG. 1.
Figure 11:
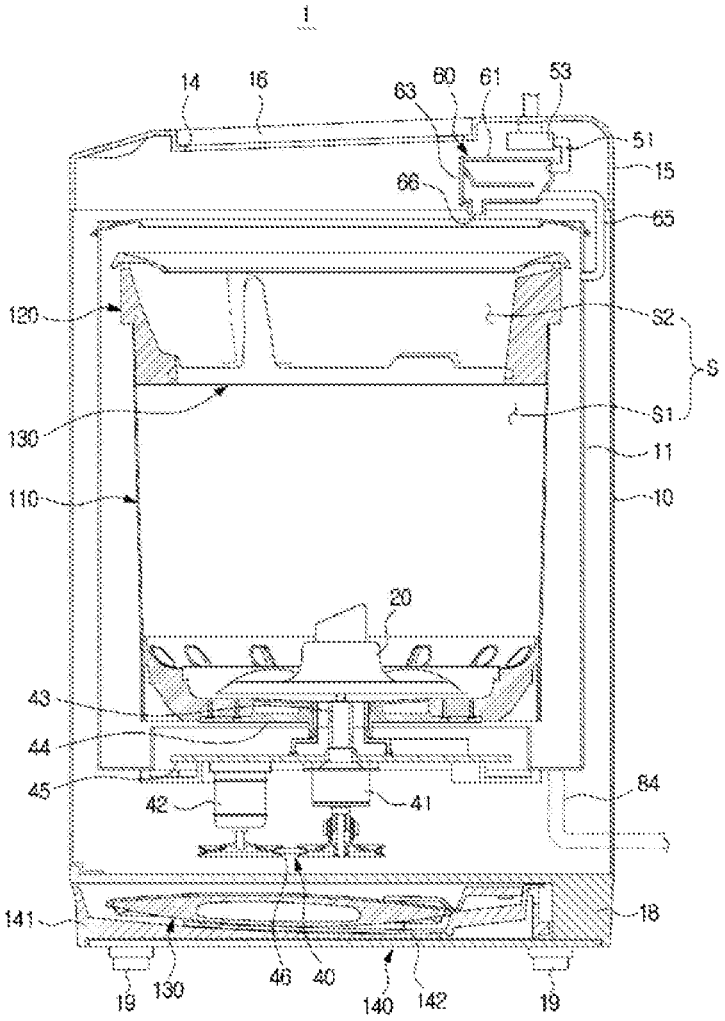
FIG. 11 is a cross-sectional view illustrating a state in which the separating plate is separated from a washing tub of the washing machine shown in FIG. 1.

FIG. 2 is an exploded view illustrating a rotating tub 110, a balancer 120, and the separating plate 130 of the washing machine 1 according to one embodiment of the present disclosure, which are disassembled. FIGS. 3 to 5 are views illustrating a process of mounting the separating plate 130 of the washing machine 1 according to one embodiment of the present disclosure on the balancer 120. FIG. 6 is a view illustrating a state in which the separating plate 130 of the washing machine 1 according to one embodiment of the present disclosure is mounted on the balancer 120. FIG. 7 is an enlarged view illustrating a part A shown in FIG. 1. FIG. 8 is a view illustrating a cross section shown in FIG. 7 when viewed obliquely from below. FIG. 9 is a view illustrating a case in which a separation preventer 124 is omitted from the balancer 120 shown in FIG. 7. FIG. 10 is a view illustrating a process of storing the separating plate 130 when not in use in the washing machine 1 shown in FIG. 1. FIG. 11 is a cross-sectional view illustrating a state in which the separating plate 130 is separated from the washing tub 100 of the washing machine 1 shown in FIG. 1.

Also, for convenience of description, in FIGS. 3, 4, 7, and 9, a side surface of a hinge connection portion 132*a* is shown instead of a cross section thereof to illustrate a hinge groove 132*aa*.

Referring to FIG. 2, the washing tub 100 of the washing machine 1 according to one embodiment of the present disclosure may include the rotating tub 110 rotatably provided inside the water tank 11, the balancer 120 provided above the rotating tub 110, and the separating plate 130 separably mounted in the washing tub 100. The washing tub 100 may form a washing space S which includes the first washing space S1 and the second washing space S2.

The rotating tub 110 has an approximate cylindrical shape with an open top surface and may be provided inside the water tank 11 to be rotatable by the driving device 40 provided therebelow.

A balancer coupling portion 111, with which the balancer 120 that will be described below is coupled, may be provided at a top end of the rotating tub 110. The balancer coupling portion 111 may include screw holes (not shown) formed along a perimeter of the balancer coupling portion while being spaced apart, so as to fix the balancer 120 using a fastening member (not shown) such as a screw and the like. However, the balancer 120 is not limited to the above coupling method and may be configured to be coupled using a stationary fitting method or may be configured to include a screw thread formed on the balancer coupling portion 111 such that the balancer 120 is coupled with the balancer coupling portion 111 using a screw coupling method.

The first washing space S1 may be formed in the rotating tub 110. The first washing space S1 may be generally formed to have a larger capacity than that of the second washing space S2 which will be described below.

The balancer 120 may have an approximate ring shape to form the second washing space S2 therein and may be provided on one side of the rotating tub 110. In detail, the balancer 120 may be coupled with and fixed to the balancer coupling portion 111 provided at the top end of the rotating tub 110. The balancer may allow the washing tub 100 to stably rotate when the washing tub 100 spins fast. The balancer 120 may include a base portion 121, a separating plate coupling portion 122 provided on an inner circumferential surface 121*a* of the base portion 121, and a balancer blade 123 protruding from the inner circumferential surface 121*a* of the base portion 121.

The base portion 121 may have an approximate ring shape and may include the second washing space S2 formed therein. The inner circumferential surface 121*a* of the base portion 121 may be provided to be inclined in a direction of receding from a rotational axis of the washing tub 100 so as to be further away from the rotating tub 110 so that washing water can be drained from the second washing space. The inner circumferential surface 121*a* of the base portion 121 may be formed to be inclined in a direction of receding from a rotational axis of the balancer 120 from a bottom end to a top end thereof. That is, the inner circumferential surface 121*a* may be formed to be inclined in a direction of receding from the rotational axis of the balancer 120 as it goes from one part of the balancer 120, on which the separating plate 130 is mounted, toward another part of the balancer 120 in which the drainage holes 125 are formed. Accordingly, the inner circumferential surface 121*a* of the balancer 120 may be considered as a drainage guide surface 121*a*. Hereinafter, the inner circumferential surface 121*a* of the balancer 121 may be referred to as the drainage guide surface 121*a*. The drainage guide surface 121*a* will be described below in detail.

Referring to FIG. 3, the separating plate coupling portion 122 may be provided at a bottom end of the base portion 121 such that the separating plate 130, which will be described below, is separably mounted thereon. The separating plate coupling portion 122 may include a hinge fixing portion 122*a*, with which the separating plate 130 is primarily coupled, and an insertion fixing portion 122*b* with which the separating plate 130 is secondarily coupled.

The hinge fixing portion 122*a* may be provided on one part of the drainage guide surface 121*a* (inner circumferential surface) of the balancer 120 such that the hinge connection portion 132*a* of the separating plate 130 is separably hinge-coupled therewith. The hinge fixing portion 122*a* may have a groove shape by recessing an inner circumferential surface of the washing tub 100. In detail, the hinge fixing portion 122*a* may have a groove shape by recessing an inner circumferential surface of the balancer 120.

The hinge fixing portion 122*a* may include a hinge protrusion 122*aa*, which is rotatably inserted into the hinge groove 132*aa* of the hinge connection portion 132*a* of the separating plate 130 when being coupled with the hinge connection portion 132*a* of the separating plate 130. The hinge protrusion 122*aa* may protrude from both side surfaces of the hinge fixing portion 122*a* in a direction perpendicular to a direction in which the separating plate 130 is inserted.

Referring to FIGS. 3 to 5, according to this configuration, a user may insert and connect the hinge connection portion 132*a* into and to the hinge fixing portion 122*a* while moving the separating plate 130 in a direction B and then may rotate the separating plate 130 on the hinge protrusion 122*aa* as a rotational axis in a direction C in which the separating plate 130 is mounted on the balancer 120.

The insertion fixing portion 122*b* may be provided on another part of the drainage guide surface 121*a* (inner circumferential surface) of the balancer 120 such that an insertion connection portion 132*b* of the separating plate 130 is separably inserted. The insertion fixing portion 122*b* may be provided such that the insertion connection portion 132*b* of the separating plate 130 is accommodated and mounted therein. The insertion fixing portion 122*b* may have a groove shape by recessing the inner circumferential surface of the washing tub 100. In detail, the insertion fixing portion 122*b* may have a groove shape by recessing the inner circumferential surface of the balancer 120.

According to this configuration, the separating plate 130 may rotate in a direction of being mounted on the balancer 120 while the hinge connection portion 132*a* is connected to the hinge fixing portion 122*a* such that the insertion connection portion 132*b* may be inserted into the insertion fixing portion 122*b* and may be mounted in and fixed to the balancer 120 as shown in FIG. 6.

A balancer blade 123 may protrude from the drainage guide surface 121*a* of the base portion 121 toward the second washing space S2 and hit laundry during a washing operation of the laundry to effectively wash the laundry. According to the embodiment, although it is shown that three balancer blades 123 are provided along the drainage guide surface 121*a* of the base portion 121, the number of the balancer blades 123 is not limited thereto.

The balancer 120 of the washing machine 1 according to the embodiment of the present disclosure may further include the separation preventer 124. The separation preventer 124 may be provided at a top end of the balancer 120 and formed to be integrally formed with the base portion 121 or may be formed separately from and coupled with the base portion 121. The separation preventer 124 may be provided at least one part along a perimeter of the top end of the balancer 120 and may extend toward the rotational axis of the balancer 120. That is, the separation preventer 124 may extend from the top end of the balancer 120 toward an inside of the balancer 120. The separation preventer 124 extends from the top end of the balancer 120 by a certain length in a radial direction of the balancer 120 and may extend to the extent that laundry inside the second washing space S2 is prevented from deviating to the outside thereof from the second washing space S2 when the balancer 120 rotates. Accordingly, since the washing machine 1 according to one embodiment of the present disclosure may prevent the laundry inside the second washing space S2 from deviating to the outside thereof from the second washing space S2 even when the washing tub 100 spins fast during a spin-drying operation, washing may be stably performed.

Referring to FIGS. 7 and 8, the balancer 120 of the washing machine 1 according to the embodiment of the present disclosure may further include a drainage hole 125 provided to discharge washing water in the second washing space S2 to the outside of the washing tub 100. The drainage hole 125 may be formed in at least one part of a perimeter of the balancer 120. The drainage hole 125 may be formed in a top end of the base portion 121. In detail, the drainage hole 125 may be formed between the base portion 121 and the separation preventer 124. A plurality of such drainage holes 125 may be formed along a perimeter of the top end of the base portion 121 while being spaced apart or may continuously formed along the perimeter of the top end of the base portion 121. The drainage holes 125 may be provided to drain the washing water from the second washing space S2 to the outside of the washing tub 100 using a centrifugal force when the balancer 120 rotates more than a predetermined speed as the washing tub 100 rotates.

As the drainage holes 125 are formed between the base portion 121 and the separation preventer 124 as described above, the balancer 120 may include a support portion 126 which connects the separation preventer 124 to the base portion 121.

According to this configuration, the washing water of the second washing space S2 may be drained to the outside of the washing tub 100 through the drainage holes 125 due to the centrifugal force when the washing tub 100 spins fast during the spin-drying process. That is, the washing water of the second washing space S2 may be drained from the second washing space S2 along a drainage path P1.

In detail, as described above, the drainage guide surface 121*a* may be formed to be inclined in a direction of receding from the rotational axis of the washing tub 100 as it goes toward the top end, at which the drainage holes provided, from the bottom end, at which the separating plate coupling portion 122 is provided, such that the washing water may be moved to the top end of the balancer 120 and discharged to the outside of the washing tub 100 by a centrifugal force when the balancer 120 rotates as the washing tub 100 rotates. That is, the washing water of the second washing space S2 may be discharged to the outside of the washing tub 100 through the drainage holes 125 of the balancer 120 during the spin-drying process.

Also, the washing machine 1 according to one embodiment of the present disclosure may be configured such that the washing water discharged from the second washing space S2 may be discharged into a space between the water tank 11 and the washing tub 100. In detail, the washing water discharged to the outside of the washing tub 100 through the top end of the balancer 120 may be drained into the space between the water tank 11 and the washing tub 100 and may be discharged outward with washing water drained from the first washing space S1 from the cabinet 10 through the drain hose 84. According to this configuration, the washing machine 1 according to one embodiment of the present disclosure may drain the washing water of the second washing space S2 without an additional drainage device for draining the washing water from the second washing space S2 such that a product unit cost may be reduced.

Referring to FIG. 9, alternatively, the balancer 120 may not include the separation preventer 124. In this case, the drainage holes 125 may not be additionally formed and the washing water inside the second washing space S2 may move to and cross the top end of the balancer 120 and may be discharged to the outside of the washing tub 100 when the balancer 120 rotates as the washing tub 100 rotates. That is, the washing water inside the second washing space S2 may be drained from the second washing space S2 along a drainage path P2. Even here, the washing water discharged to the outside of the washing tub 100 may be discharged into the space between the water tank 11 and the washing tub 100.

The separating plate 130 may be provided to be separably mounted in the washing tub 100 so as to be optionally mounted in the washing tub 100 according to the user's need and may divide the washing space S into the first washing space S1 and the second washing space S2. In detail, the separating plate 130 may be provided to be separable from the balancer 120 of the washing tub 100. However, the separation plate 130 is not limited thereto and may be provided to be separably mounted on the rotating tub 110. The separating plate 130 may include a handle 131, a washing tub connection portion 132, and a sealing member 133.

The handle 131 may protrude from one surface of the separating plate 130, which faces the opening 14 of the cabinet 10 when the separating plate 130 is mounted in the washing tub 100. The handle 131 may protrude from a top surface of the separating plate 130 when the separating plate 130 is mounted in the washing tub 100. The handle 131 may include a grip portion 131*a* to allow the user to easily grip the separating plate 130. That is, the user may easily move the separating plate 130 by gripping the handle 131 when mounting or separating the separating plate 130 in or from the washing tub 100.

The washing tub connection portion 132 may be provided to be separably mounted on the balancer 120 of the washing tub 100 and may be provided at one part of a perimeter of the separating plate 130. The washing tub coupling portion 132 may include the hinge connection portion 132*a* which is primarily coupled with the balancer 120, and an insertion fixing portion 132*b* which is secondarily coupled with the balancer 120.

The hinge fixing portion 132*a* may be provided on one part of an outer circumferential surface of the separating plate 130 so as to be separably hinge-coupled with the hinge fixing portion 122*a* of the balancer 120. The hinge connection portion 132*a* may include the hinge groove 132*aa* in which the hinge protrusion 122*aa* of the hinge fixing portion 122*a* is rotatably inserted when being coupled with the hinge fixing portion 122*a*. The hinge groove 132*aa* may protrude from both side surfaces of the hinge connection portion 132*a* in a direction perpendicular to a direction in which the separating plate 130 is inserted into the balancer 120. In addition, the hinge groove 132*aa* may extend along the direction, in which the separating plate 130 is inserted, and have an approximate overall elliptical shape such that the hinge protrusion 122*a* is inserted therein.

Referring to FIGS. 4 and 5, according to this configuration, the hinge connection portion 132*a* may be primarily inserted into and connected to the hinge fixing portion 122*a* and the separating plate 130 may be rotated in a direction of being mounted on the balancer 120 on the hinge protrusion 122*aa* as a rotational axis.

The insertion connection portion 132*b* may be provided on another part of the outer circumferential surface of the separating plate 130 to be separably inserted into the insertion fixing portion 122*b* of the balancer 120. The insertion connection portion 132*b* may be provided to be accommodated and mounted in the insertion fixing portion 122*b* of the balancer 120. According to this configuration, the separating plate 130 may rotate in a direction of being mounted on the balancer 120 while the hinge connection portion 132*a* is connected to the hinge fixing portion 122*a* such that the insertion connection portion 132*b* may be inserted into the insertion fixing portion 122*b* and may be mounted in and fixed to the balancer 120 as shown in FIG. 6.

In the embodiment, although it has been described that the hinge fixing portion 122*a* and the insertion fixing portion 122*b* of the balancer 120 are provided at opposite parts of the separating plate coupling portion 122 inside the balancer 120 and the hinge connection portion 132*a* and the insertion connection portion 132*b* of the separating plate 130 are provided at opposite parts of the perimeter of the separating plate 130 corresponding thereto, positions, at which the hinge fixing portion 122*a*, the insertion fixing portion 122*b*, the hinge connection portion 132*a*, and the insertion connection portion 132*b* are formed, are not limited thereto and any positions may be applied in which one end of the separating plate 130 is hinge-coupled and the other end thereof is inserted into and fixed to the balancer 120.

The sealing member 133 may be continuously provided along the perimeter of the separating plate 130 and may be provided on at least one part of the perimeter. When the separating plate 130 is mounted on the balancer 120, the sealing member 133 completely separates the washing tub 100 into the first washing space S1 and the second washing space S2 to prevent the washing water of the second washing space S2 from flowing into the first washing space S1. That is, the sealing member 133 may seal a space between the outer circumferential surface of the separating plate 130 and an inner circumferential surface of the separating plate coupling portion 122 of the balancer 120 when the separating plate 130 is mounted on the balancer 120. In detail, the sealing member 133 may be pressed against the outer circumferential surface of the separating plate 130 and the inner circumferential surface of the separating plate coupling portion 122 of the balancer 120. To this end, the sealing member 133 may include a rubber material.

The washing machine 1 according to one embodiment of the present disclosure may prevent laundry from being stained using the sealing member 133 which prevents the washing water of the first washing space S1 and the washing water of the second washing space S2 from being mixed with each other.

The separating plate 130 may include a transparent portion 134 having transparency to see an inside of the first washing space S1 when the separating plate 130 is mounted in the washing tub 100. In detail, the separating plate 130 may include the handle 131 provided along a diameter direction of a separating plate frame 130*a* having a ring shape and the transparent portion 134 may be provided at an opening formed inside the separating plate frame 130*a*. Accordingly, the user may see the inside of the first washing space S1 even when the separating plate 130 is installed on the balancer 120 of the washing tub 100.

Referring to FIGS. 10 and 11, the washing machine 1 according to one embodiment of the present disclosure may further include the separating plate storage device 140 provided to store the separating plate 130 when not in use.

In detail, as shown in FIG. 11, the user may not perform separate washing by separating the washing space S formed by the washing tub 100 into the first washing space S1 and the second washing space S2 and may perform overall washing using the washing space S as a whole. In this case, the user may separate the separating plate 130 from the washing tub 100 and separately store the separating plate 130. When the storage device 140 is not provided in the washing machine 1, since it is necessary to separately store the separating plate 130, there is a risk of the separating plate 130 being lost or damaged.

To this end, the washing machine 1 according to one embodiment of the present disclosure may include the separating plate storage device 140 capable of storing the separating plate 130.

The separating plate storage device 140 may include a separating plate drawer 141 provided below the cabinet 10 to be slidably withdrawn from the cabinet 10 or drawn into the cabinet 10 and a separating plate mounting portion 142 on which the separating plate 130 is mounted.

The separating plate drawer 141 may be provided to be slidably withdrawn from or drawn into the cabinet 10. Here, a drawing-in or withdrawing operation may be manually performed by the user or may be automatically performed using a sensor and a motor.

In detail, when the drawing-in or withdrawing operation of the separating plate drawer 141 is manually performed, the separating plate drawer 141 may include a drawer handle (not shown) which can be gripped by the user. Alternatively, the separating plate drawer 141 may be configured to be withdrawn from the cabinet 10 when being pressed in a direction of drawing in the separating plate drawer 141 while being drawn in the cabinet 10 and configured to remain in a state of being drawn into the cabinet 10 when being pressed again in the direction of drawing in the separating plate drawer 141 while being withdrawn from the cabinet 10.

Alternatively, when the drawing-in or withdrawing operation of the separating plate drawer 141 is automatically performed, the separating plate drawer 141 may include a sensor (not shown) and a motor (not shown). In detail, the separating plate drawer 141 may be configured such that when the user inputs a command using a remote controller, the sensor receives the command and drives the motor to open or close the separating plate drawer 141. Also, the separating plate drawer 141 may be configured such that the sensor recognizes a particular action of the user and drives the motor to open or close the separating plate drawer 141.

The separating plate mounting portion 142 may fix the separating plate 130 so as not to move in the separating plate drawer 141. Accordingly, the washing machine 1 according to one embodiment of the present disclosure may prevent the separating plate 130 from being damaged by an external impact and the like while being stored in the separating plate drawer 141. Additionally, the separating plate mounting portion 142 may include an impact-mitigating member (not shown) at a part which comes into contact with the separating plate 130.

Hereinafter, operations of the washing machine 1 according to one embodiment of the present disclosure will be described.

Referring to FIG. 3, the user inserts laundry into the first washing space S1 when it is intended to perform separate washing. Afterwards, the user may withdraw the separating plate 130 from the separating plate storage device 140 in order to mount the separating plate 130 on the balancer 120 of the washing tub 100. Then, the user may move the separating plate 130 in the direction B in order to connect the hinge connection portion 132*a* of the separating plate 130 to the hinge fixing portion 122*a* of the balancer 120.

Afterwards, referring to FIGS. 4 and 5, the user may rotate the separating plate 130 in a direction C in order to insert and fix the insertion connection portion 132*b* of the separating plate 130 into and to the hinge connection portion 122*b* of the balancer 120 while the hinge connection portion 132*a* of the separating plate 130 is rotatably connected to the hinge fixing portion 122*a* of the balancer 120. Here, the hinge groove 132*aa* of the hinge connection portion 132*a* and the hinge protrusion 122*aa* of the hinge fixing portion 122*a* may be the rotational axis of the separating plate 130.

Afterwards, as shown in FIG. 6, when the separating plate 130 is completely mounted, the user may insert laundry into the second washing space S2. Accordingly, since the user may wash loads of laundry, which need separate washing, at the same time, power consumption may be reduced and a washing time may be reduced.

In addition, in the washing machine 1 according to one embodiment of the present disclosure, since the washing water in the second washing space S2 is discharged into the space between the water tank 11 and the washing tub 100 through the drainage holes 125 of the balancer 120 and is drained with the washing water of the first washing space S1 when spin-drying is performed, an additional drainage structure is not necessary and a product unit cost may be reduced.

Afterwards, when the user intends to perform washing using the whole washing space S of the washing tub 100 instead of separate washing, the user may separate the separating plate 130 mounted on the balancer 120 of the washing tub 100 in a reverse sequence of the above-described mounting sequence and may store the separating plate 130 in the separating plate storage device 140 as shown in FIG. 11. Hereby, since the separating plate 130 may be safely stored when not in use, the separating plate 130 may be prevented from being lost or damaged.

As described above, since the washing space S of the washing tub 100 may be simply separated using the separating plate 130 as necessary in the washing machine 1 of the present disclosure, convenience in use may be increased. In addition, since separate washing may be performed using one washing tub at the same time, power consumption may be reduced, a washing time may be reduced, and a product unit cost may be reduced in comparison to washing machines including a plurality of washing apparatuses.

Figure 12:
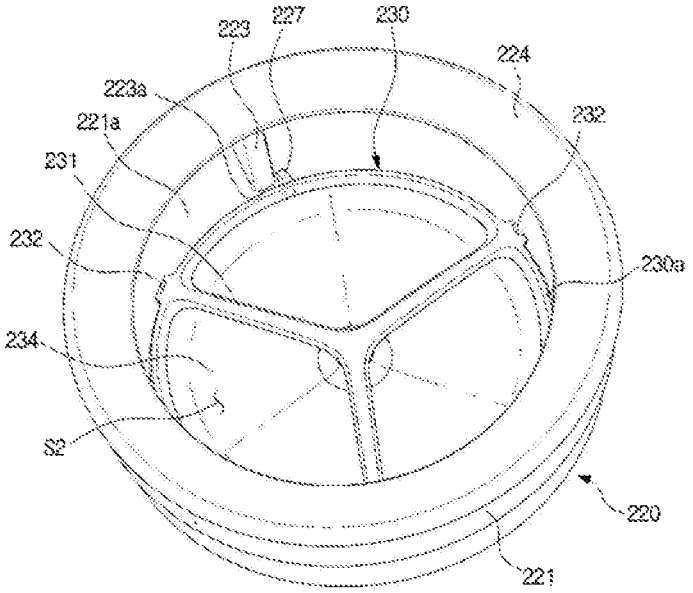
FIG. 12 is a view illustrating a balancer and a separating plate according to another embodiment of the present disclosure.
Figure 13:
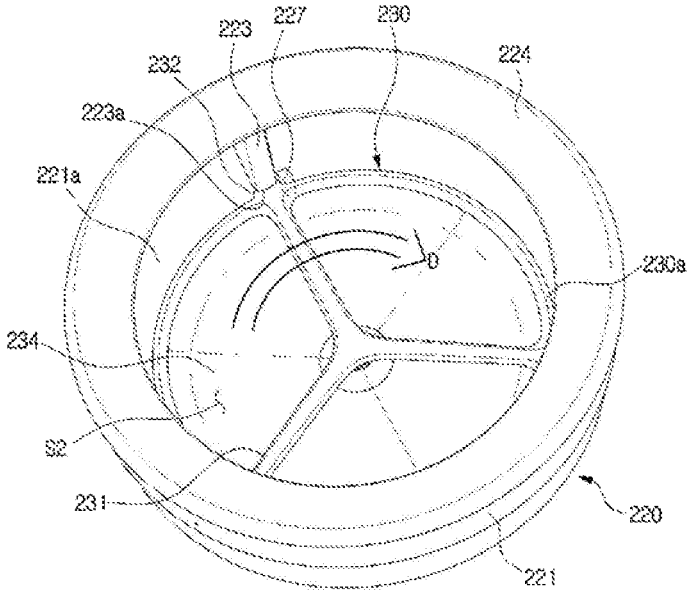
FIG. 13 is a view illustrating a method of coupling the separating plate with the balancer shown in FIG. 12.
Figure 14:
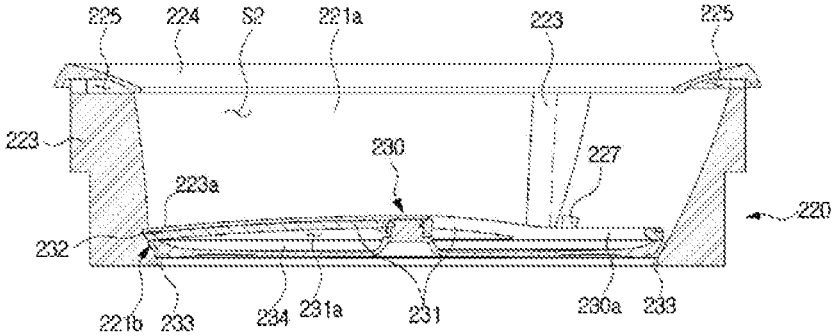
FIG. 14 is a cross-sectional view illustrating the balancer and the separating plate shown in FIG. 13.

FIG. 12 is a view illustrating a balancer 220 and a separating plate 230 according to another embodiment of the present disclosure. FIG. 13 is a view illustrating a method of coupling the separating plate 230 shown in FIG. 12 with the balancer 220. FIG. 14 is a cross-sectional view illustrating the balancer 220 and the separating plate 230 shown in FIG. 13.

The balancer 220 and the separating plate 230 according to another embodiment will be described with reference to FIGS. 12 to 14. Like components of the embodiment shown in FIGS. 1 to 11 will be denoted by like reference numerals, and a description thereof will be omitted.

Referring to FIGS. 12 to 14, the balancer 220 according to another embodiment may have an approximate ring shape to form a second washing space S2 therein. The balancer 220 may include a base portion 221, a balancer blade 223 protruding from an inner circumferential surface 221*a* of the base portion 221, and a rotation preventer 227 protruding from the inner circumferential surface 221*a* of the base portion 221.

The base portion 221 may have an approximate ring shape and may include the second washing space S2 formed therein. That is, the inner circumferential surface 221*a* of the base portion 221 may be formed to be inclined in a direction of receding from a rotational axis of the balancer 220 as it goes from one part of the balancer 220, on which the separating plate 230 is mounted, toward another part of the balancer 220 in which drainage holes 225 are formed. Accordingly, the inner circumferential surface 221*a* of the balancer 220 may be considered as a drainage guide surface 221*a*.

The balancer blade 223 may protrude from the drainage guide surface 221*a* of the base portion 221 toward the second washing space S2. The balancer blade 223 may include a balancer fixing portion 223*a* which is provided at a bottom end thereof and presses and fixes the separating plate 230.

The balancer fixing portion 223*a* may be provided at the bottom end of the balancer blade 223 and may fix the separating plate 230 by pressing a separating plate fixing portion 232 of the separating plate 230, which will be described below. In detail, when the separating plate 230 is primarily mounted on the balancer 220 and then rotates in one direction (a direction D) and is located at a fixing position by a rotation preventer 227 which will be described below, the separating plate fixing portion 232 of the separating plate 230 may be fixed between the balancer fixing portion 223*a* and a support surface 221*b* using a stationary fixing method.

As shown in FIGS. 12 and 13, like the balancer blade 223, three balancer fixing portions 223*a* may be provided along the drainage guide surface 221*a* of the base portion 221 but the number of the balancer fixing portions 223*a* is not limited thereto.

The rotation preventer 227 may be provided at one part of the drainage guide surface 221*a* of the balancer 220, which is different from the one part on which the balancer blade 223*a* is formed. The rotation preventer 227 may be provided to restrict the separating plate 230 from rotating in one direction (direction D) when the separating plate 230 is mounted on the balancer 220 and rotates in one direction (direction D) to be fixed. In detail, the rotation preventer 227 may interfere with the separating plate fixing portion 232 of the separating plate 230 and may prevent rotation of the separating plate 230.

The rotation preventer 227 may be provided to be adjacent to one part of the drainage guide surface 221*a* on which the balancer blade 223 is formed. Accordingly, the number of the rotation preventers 227 may correspond to the number of the balancer blades 223 but is not limited thereto. The rotation preventer 227 may be integrally formed with the base portion 221 or may be provided separately from the base portion 221 and may be installed on the base portion 221.

In addition, the balancer 220 according to another embodiment of the present disclosure may further include a separation preventer 224 for preventing laundry inside the second washing space S2 from deviating to the outside thereof from the second washing space S2.

Referring to FIGS. 12 to 14, the separating plate 230 according to another embodiment may be optionally mounted on the balancer 220 of the washing tub 100 according to the user's need. The separating plate 230 may include a handle 231, the separating plate fixing portion 232, and a sealing member 233.

The handle 231 may protrude from a top surface of the separating plate when the separating plate 230 is mounted on the balancer 220. The handle 231 may include a grip portion 231*a* to allow the user to easily grip the separating plate 230.

The separating plate fixing portion 232 may be provided to protrude outward from a separating plate frame 230*a* of the separating plate 230 in a radial direction. The number of the separating plate fixing portions 232 may correspond to the number of the balancer fixing portions 223*a* and the number of the rotation preventers 227 but is not limited thereto.

The separating plate fixing portion 232 may be pressed by the balancer 220 to be fixed to a position at which the separating plate 230 is fixed to the balancer 220. In detail, the separating plate fixing portion 232 is spaced apart from the balancer fixing portion 223*a* and the rotation preventer 227 while the separating plate 230 is primarily mounted on the balancer 220. Afterwards, as the user rotates the separating plate 230 in one direction (direction D), the separating plate fixing portion 232 faces the rotation preventer 227. When the separating plate fixing portion 232 approaches a position of being restricted from rotating by the rotation preventer 227, the separating plate fixing portion 232 is at a position of being fixed by the balancer fixing portion 223*a*. Accordingly, the separating plate fixing portion 232 may be fixed between the balancer fixing portion 223*a* and the support surface 221*b* using a stationary fitting method. That is, the separating plate fixing portion 232 may be vertically pressed and fixed by the balancer fixing portion 223*a* and the support surface 221*b*.

The sealing member 233 may be continuously provided along a perimeter of the separating plate 230 and may be provided on at least one part of the perimeter. When the separating plate 230 is mounted on the balancer 220, the sealing member 233 completely separates the washing tub 100 into the first washing space S1 and the second washing space S2 to prevent the washing water of the second washing space S2 from flowing into the first washing space S1.

In addition, the separating plate 230 according to another embodiment of the present disclosure may further include a transparent portion 234 having transparency. The transparent portion 234 may allow the user to see laundry inside the first washing space S1 even when the separating plate 230 is mounted on the balancer 220. In detail, the transparent portion 234 may be provided at an opening formed inside the separating plate frame 230*a*.

With this configuration, in a washing machine according to another embodiment of the present disclosure, since the separating plate 230 may be simply mounted and separated on and from the balancer 220, separate washing and whole washing may be easily selected and performed.

Particular embodiments have been illustrated and described above. However, the present disclosure is not limited to the embodiments and it should be appreciated by one of ordinary skill in the art that a variety of changes may be made without departing from the technical concept of the present disclosure defined in the claims.

The invention claimed is:

1. A washing machine comprising:

a cabinet comprising an opening;

a water tank provided inside the cabinet and configured to store water;

a washing tub rotatably provided inside the water tank, configured to form a washing space, and the washing tub comprising:

a rotating tub and a balancer provided on one side of the rotating tub and drainage holes formed in at least one part of a perimeter of the balancer, a separating plate separably mounted in the washing tub to optionally separate the washing space of the washing tub into a first washing space and a second washing space, wherein the balancer comprises a hinge fixing portion provided at one part of an inner circumferential surface of the balancer, and wherein the separating plate comprises a hinge connection portion provided on one part of an outer circumferential surface of the separating plate and configured to be separably hinge-connected to the hinge fixing portion.

2. The washing machine of claim 1, wherein the balancer comprises an insertion fixing portion provided at another part of the inner circumferential surface of the balancer, and wherein the separating plate comprises an insertion connection portion provided on another part of the outer circumferential surface of the separating plate and configured to be separably inserted into the insertion fixing portion.

3. The washing machine of claim 1, wherein the balancer comprises:

a balancer fixing portion provided on one part of an inner circumferential surface of the balancer and protruding toward an inside of the balancer to fix the separating plate when the separating plate is mounted in the washing tub; and a rotation preventer provided on another part of the inner circumferential surface of the balancer and protruding toward the inside of the balancer to restrict the separating plate from rotation in one direction with respect to the washing tub.

4. The washing machine of claim 3, wherein the separating plate comprises a separating plate fixing portion provided on at least one part of an outer circumferential surface of the separating plate to be fixed by the balancer fixing portion of the balancer and the rotation preventer, and wherein the separating plate fixing portion is configured to move to a position of being fixed by the balancer fixing portion as the separating plate rotates in the one direction with respect to the washing tub.

5. The washing machine of claim 1, wherein the cabinet comprises a separating plate storage device provided to store the separating plate when the separating plate is separated from the balancer.

6. The washing machine of claim 5, wherein the separating plate storage device comprises a separating plate drawer which accommodates the separating plate and is slidably drawn into or withdrawn from the cabinet.

7. The washing machine of claim 1, wherein the balancer comprises a separation preventer provided on at least one part along the perimeter of the balancer and extending toward a rotational axis of the balancer.

8. The washing machine of claim 1, wherein the separating plate comprises a handle protruding from one surface facing the opening of the cabinet when the separating plate is mounted on the balancer.

9. The washing machine of claim 1, wherein the balancer comprises a drainage guide surface formed to be inclined in a direction of receding from a rotational axis of the balancer as it goes from one part of an inner circumferential surface of the balancer, on which the separating plate is mounted, toward another part of the inner circumferential surface of the balancer, in which the drainage holes are formed.

10. The washing machine of claim 1, wherein the balancer comprises a balancer blade protruding from an inner circumferential surface of the balancer.

11. The washing machine of claim 1, wherein the separating plate comprises a transparent portion having transparency to see an inside of the first washing space when the separating plate is mounted in the washing tub.

12. The washing machine of claim 1, wherein the separating plate comprises a sealing member provided on at least one part of a perimeter thereof.

13. The washing machine of claim 1, wherein the drainage holes are provided to drain water of the second washing space to an outside of the washing tub using a centrifugal force when the balancer rotates at a predetermined speed.

14. The washing machine of claim 1, wherein the drainage holes are configured to guide water of the second washing space to an outside of the washing tub but still inside the water tank.

* * * * *